US008402795B2

(12) United States Patent
Failenschmid

(10) Patent No.: US 8,402,795 B2
(45) Date of Patent: Mar. 26, 2013

(54) METHOD FOR MANUFACTURING A TUBULAR KNITTED ARTICLE

(75) Inventor: Otto Failenschmid, Gomadingen (DE)

(73) Assignee: H. Stoll GmbH & Co. KG, Reutlingen (DE)

( * ) Notice: Subject to any disclaimer, the term of this patent is extended or adjusted under 35 U.S.C. 154(b) by 0 days.

(21) Appl. No.: 13/233,154

(22) Filed: Sep. 15, 2011

(65) Prior Publication Data

US 2012/0067087 A1 Mar. 22, 2012

(30) Foreign Application Priority Data

Sep. 18, 2010 (DE) ..... 10 2010 046 019
Mar. 1, 2011 (DE) ..... 10 2011 012 767

(51) Int. Cl.
*D04B 7/04* (2006.01)

(52) U.S. Cl. ..... 66/64

(58) Field of Classification Search ..... 66/64, 65, 66/69, 169 R, 170, 171, 174, 176, 177
See application file for complete search history.

(56) References Cited

U.S. PATENT DOCUMENTS

| | | | | |
|---|---|---|---|---|
| 5,299,435 | A * | 4/1994 | Whalley | 66/61 |
| 5,429,555 | A | 7/1995 | Beckh | |
| 6,766,667 | B2 * | 7/2004 | Dohtsu et al. | 66/69 |
| 6,786,066 | B2 * | 9/2004 | Okamoto | 66/172 R |
| 7,577,488 | B2 * | 8/2009 | Okamoto | 700/141 |
| 2004/0093907 | A1 * | 5/2004 | Dohtsu et al. | 66/64 |
| 2009/0308108 | A1 * | 12/2009 | Okamoto | 66/176 |
| 2012/0067087 | A1 * | 3/2012 | Failenschmid | 66/170 |

FOREIGN PATENT DOCUMENTS

| | | |
|---|---|---|
| BE | 789 902 | 2/1973 |
| DE | 43 17 652 | 12/1994 |
| DE | 196 30 006 | 1/1998 |
| DE | 692 32 243 | 6/2002 |
| EP | 0 533 612 | 3/1993 |
| EP | 0 839 940 | 5/1998 |
| RO | 122816 | 7/2010 |

* cited by examiner

*Primary Examiner* — Danny Worrell
(74) *Attorney, Agent, or Firm* — Michael J. Striker

(57) ABSTRACT

Manufacturing a tubular knitted article on a flat knitting machine includes using at least two diametrically opposed needle beds, which has plain stitches and purl stitches in each stitch row, wherein purl stitches follow the plain stitches of a stitch row in a subsequent stitch row, and plain stitches follow the purl stitches of the stitch row in the subsequent stitch row.

8 Claims, 14 Drawing Sheets

METHOD FOR MANUFACTURING A TUBULAR KNITTED ARTICLE

CROSS-REFERENCE TO RELATED APPLICATION

The invention described and claimed hereinbelow is also described in German Patent Application DE 10 2010 046 019.2 filed on Sep. 18, 2010 and German Patent Application DE 10 2011 012 767.4 filed on Mar. 1, 2011. These German Patent Applications, whose subject matter is incorporated here by reference, provides the basis for a claim of priority of invention under 35 U.S.C. 119(a)-(d).

BACKGROUND OF THE INVENTION

The invention relates to a method for manufacturing a tubular knitted article, which has plain stitches and purl stitches in each stitch row, on a flat knitting machine comprising at least two diametrically opposed needle beds, wherein, at least past a vertical section of the knitted article, purl stitches follow the plain stitches of a stitch row in a subsequent stitch row, and plain stitches follow the purl stitches of this stitch row in the subsequent stitch row.

Tubular knitted articles can be manufactured as smooth-surface knitted articles which, however, tend to roll up at the edges of the knitted article. They can also be formed as ribbed knitted articles, in which case plain stitches and purl stitches alternate, thereby producing a knitted article having high transverse elasticity and relatively high longitudinal elasticity. A method for manufacturing such a tubular ribbed knitted article is disclosed in BE 789902 A1, for example. In that case, the plain stitches and purl stitches for the front part and the back part are formed in alternation using one stroke of the carriage in each case. A large quantity of thread material is inlaid into the knitted article to connect the loops on the front needle bed and the rear needle bed. The result is an unstable knitted article having high elasticity.

SUMMARY OF THE INVENTION

The problem addressed by the present invention is that of manufacturing a tubular knitted article having high stability and relatively low elasticity in the longitudinal direction, and which does not roll up at the edges of the knitted article.

The problem is solved by a method for manufacturing a tubular knitted article, which has plain stitches and purl stitches in each stitch row, on a flat knitting machine comprising at least two diametrically opposed needle beds, wherein, at least past a vertical section of the knitted article, purl stitches follow the plain stitches of a stitch row in a subsequent stitch row, and plain stitches follow the purl stitches of the stitch row in the subsequent stitch row in each case, comprising the steps:

a) Manufacture a tubular basic knitted article using at least one stitch row, wherein every needle of one needle bed occupied by a loop is opposite an empty needle of the other needle bed;
b) Form plain stitches on the first and/or second needle bed after transferring the loops to be knitted as purl stitches to the opposite needle bed;
c) Return the loops transferred in step b) to their original needles;
d) Form purl stitches on the first and/or second needle bed after they have been transferred to the opposite needle bed;
e) Return the loops transferred in step d) to their original needles;

f) Form plain stitches on the first and/or second needle bed using the needles that formed purl stitches in step d), after the plain stitches formed in step b) have been transferred to the opposite needle bed;
g) Return the loops transferred in step f) to their original needles;
h) Form purl stitches on the first and/or second needle bed using the needles that formed plain stitches in step b), after these loops have been transferred to the opposite needle bed;
i) Return the loops transferred in step h) to their original needles;
j) Repeat steps b) through i).

According to this method, a tubular knitted article is produced, in which plain stitches and purl stitches alternate not only within one stitch row, but also in the direction of the wales. By utilizing this weaving technique, it is ensured that the edges of the knitted article do not roll up. In addition, by alternating plain stitches and purl stitches in the direction of the wales as well, the knitted article is provided with slight elasticity in the longitudinal direction. Such tubular knitted articles can therefore be used preferably to manufacture drive belts or coverings for furniture or the like, for which slight longitudinal expansion and high stability are desired in order to ensure high dimensional stability of the knitted articles.

A further feature of a tubular knitted article manufactured according to the method according to the invention is that the inner side and the outer side of the tubular knitted article have the same appearance. By producing the plain stitches and the purl stitches in alternation, the plain stitches on the visible side are covered by floating threads of the purl stitches on the visible side. The knitted article takes on a braided appearance as a result.

A further advantage of producing the plain stitches and the purl stitches in alternation is that the amount of thread required to manufacture the knitted article can be kept relatively low.

The knitted article can be manufactured in different ways in order to set the desired longitudinal and transverse elasticity. One possibility for obtaining particularly high stability in the transverse and longitudinal directions of the knitted article is to alternate plain stitches and purl stitches in an offset manner in one stitch row and in the wales.

In a further possible embodiment of the method, steps b) to e) can be repeated at least once, and steps f) to i) can also be repeated at least once. If the knitted article is manufactured this way, the sections with plain stitches and purl stitches are located at the same points across several stitch rows in the circumferential direction of the knitted article before the plain stitches and purl stitches become mutually offset, i.e. purl stitches are formed using the needles that previously formed the plain stitches, and vice versa. If the knitted article is manufactured in this manner, it has greater elasticity in the longitudinal direction than if plain stitches and purl stitches are offset in every successive stitch row.

The order of plain stitches and purl stitches within one stitch row can also be varied. For instance, the stitch rows can be knitted in a 1:1-, 2:2- or 3:3-right/left construction, i.e. one plain stitch and one purl stitch, or two plain stitches and two purl stitches, or three plain stitches and three purl stitches are formed in alternation in each case across the entire stitch row. The number of plain stitches and purl stitches does not have to be the same, of course. The stitch rows can therefore also be knitted in a 2:1-, 3:1- or 3:2-right/left construction, i.e. they can have more plain stitches than purl stitches. Conversely, it is also possible to provide more purl stitches than plain stitches, and to knit the stitch rows in a 1:2-, 1:3- or 2:3-right/left construction, for example.

The transverse elasticity of the knitted article can be influenced in particular by selecting different constructions for each stitch row.

Preferably, a regular construction pattern is selected for the entire knitted article. Irregular distributions of plain stitches and purl stitches in the stitch rows can be selected, however, at least in areas.

The tubular knitted article can be knitted according to the method as a closed tube or a tube that is open on one side.

A weft thread can also be inlaid into the tubular knitted article in a few stitch rows by forming tuck loops using the weft thread on empty needles of a needle bed. The transverse expansion of the knitted article can be reduced to a desired level in this manner. The knitted article is thereby provided with even greater stability. Potential materials for the weft threads are glass fibers, aramids, or similar stable materials.

The invention also relates to a knitted article that comprises plain stitches and purl stitches in each stitch row, wherein purl stitches follow the plain stitches of a stitch row in a subsequent stitch row, and plain stitches follow the purl stitches of the stitch row in the subsequent stitch row, and which is manufactured according to a method according to one of the claims 1 to 6 on a flat knitting machine having at least two diametrically opposed needle beds.

Preferred embodiments of a method according to the invention are described in detail below with reference to the drawing.

DESCRIPTION OF THE PREFERRED EMBODIMENTS

Figure 1:
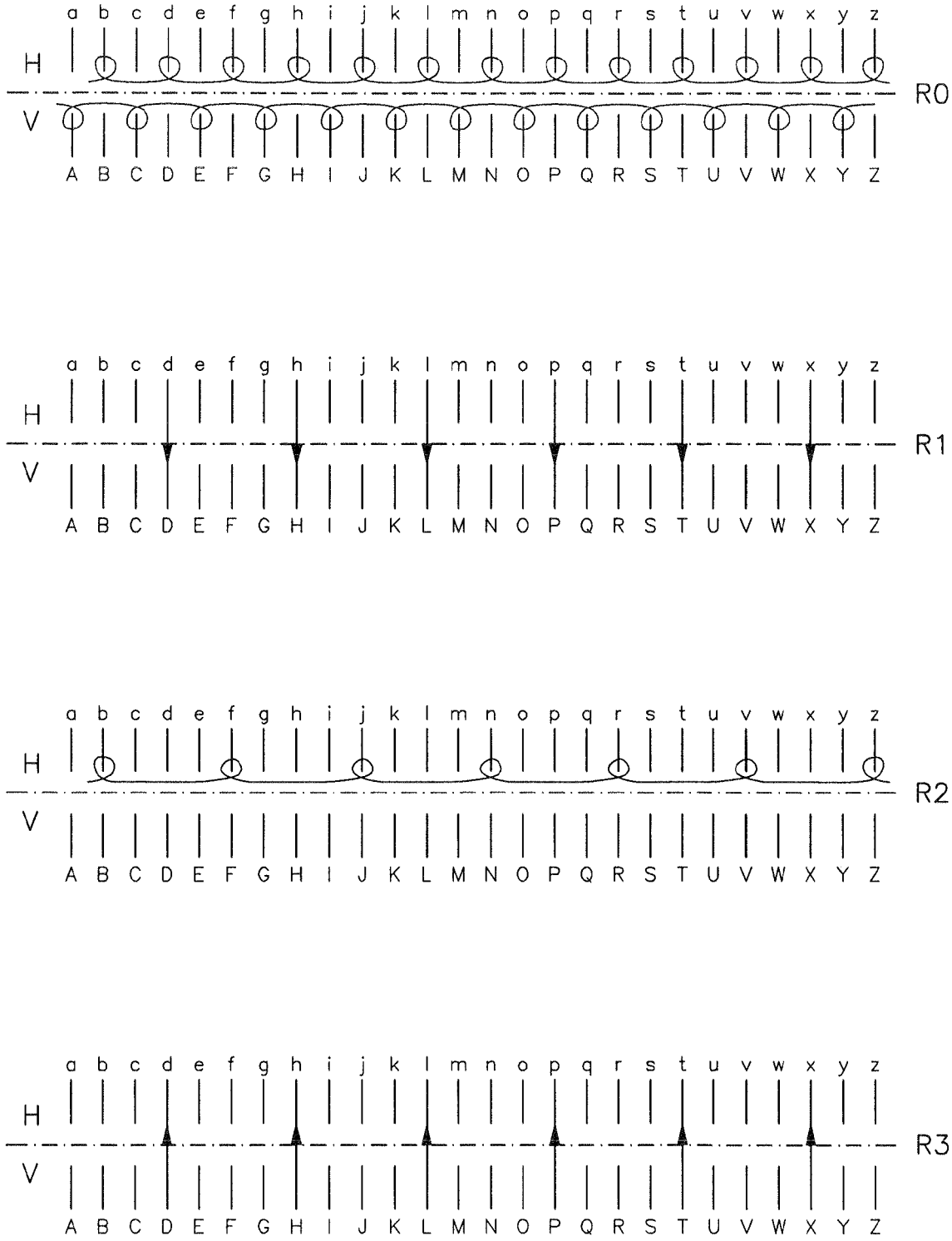
FIG. 1-FIG. 7 show a sequence of knitting rows for executing one pass of a first method.
Figure 2:
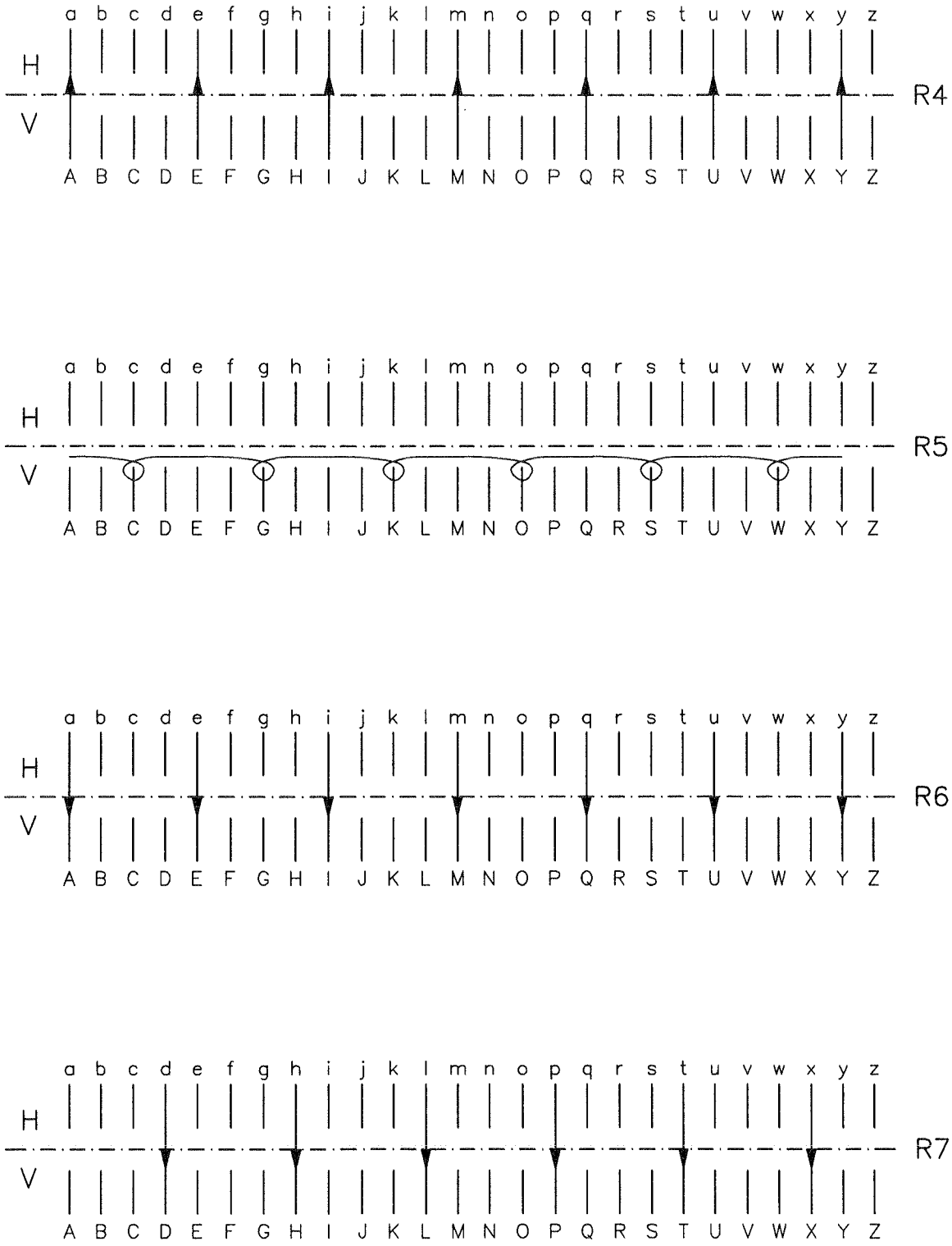
Figure 3:
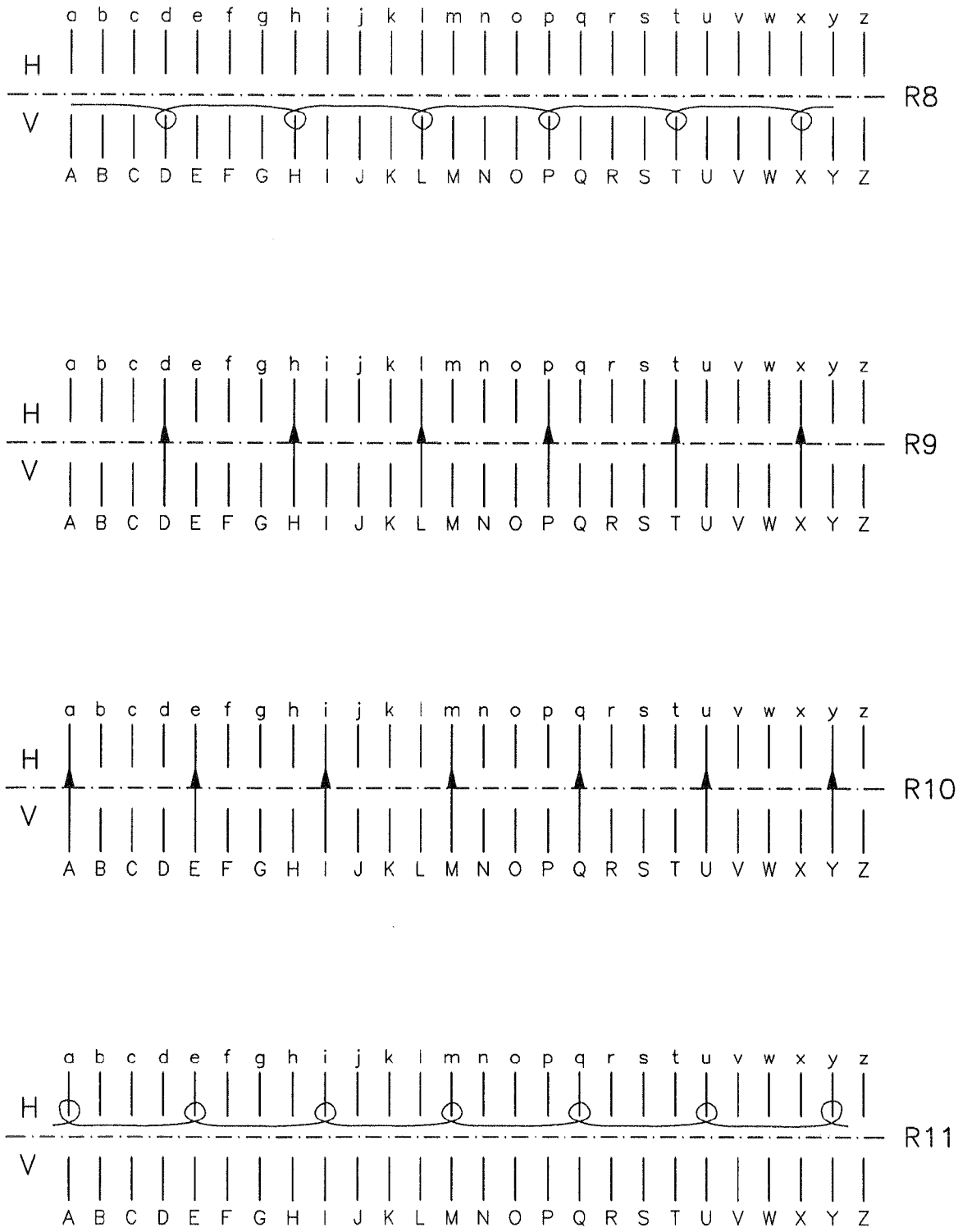

All knitting rows R0 to R24 of both methods are shown in a so-called yarn course display. The front needle bed V and the rear needle bed H are indicated schematically in each case. The needles of the front needle bed are indicated by dashes labelled with upper case letters A to Z, and the needles of the rear needle bed H are indicated by dashed labelled with lower case letters a to z.

The needle occupancy at the onset of production of the tubular knitted article on the front needle bed V and the rear needle bed H is shown in row R0, wherein a loop is present on every second needle, and an empty needle of the other needle bed H, V is situated opposite every needle of a needle bed V, H on which a loop is present.

In row R1, every second loop of the rear part of the knitted article, i.e. the loops on needles d, h, l, p, t, x of rear needle bed H are transferred to the respective opposite empty needles D, H, L, P, T, X of the front needle bed V before plain stitches for the rear part of the knitted article are formed in row R2 on needles b, f, j, n, r, v, z of the rear needle bed, the loops of which were not transferred. Next, in row R3, the loops of the rear part of the knitted article, which were transferred to the front needle bed in row R1, are returned to their original needles d, h, l, p, t, x. In row R4, every second loop of the front part of the knitted article, i.e. the loops of needles A, E, I, M, Q, U and Y of the front needle bed, is transferred to the respective opposite empty needle a, e, i, m, q, u and y of the rear needle bed H before plain stitches for the front part of the knitted article are formed in row R5 on needles C, G, K, O, S, W of the front needle bed, the loops of which were not transferred. Next, in row R6, the loops of the front part of the knitted article, which were transferred to the rear needle bed in row R4, are returned to their original needles A, E, I, M, Q, U and Y of the front needle bed V.

In rows R1 to R6, plain stitches were therefore formed on the front needle bed (needles C, G, K, O, S, W) and the rear needle bed (needles b, f, j, r, v, z) using every second needle in each case.

Next, in row R7, every second loop of the rear part of the knitted article, i.e. the loops on needles d, h, l, p, t, x of the rear needle bed are transferred again to the respective opposite empty needle D, H, L, P, T and X of the front needle bed. Next, in row R8, loops are formed on the loops of the rear part of the knitted article, which were transferred to needles D, H, L, P, T and X of the front needle bed in row R7. In row R9, the loops of the rear part of the knitted article, which were formed on the front needle bed in row R8, are then returned to their original needles d, h, l, p, t and x of the rear needle bed. They appear as purl stitches on the visible side of the rear part of the knitted article. Next, in row R10, every second loop of the front part of the knitted article, i.e. the loops of needles A, E, I, M, Q, U and Y of the front needle bed are again transferred to the particular opposite empty needle a, e, i, m, q, u and y of the rear needle bed, before loops are formed in row R11 on the loops of the front part of the knitted article that were transferred to needles a, e, i, m, q, u, y of the rear needle bed in row R10. Next, in row R12, the loops of the front part of the knitted article, which were formed on the rear needle bed in row R11, are returned to their original needles A, E, I, M, Q, U and Y of the front needle bed. They therefore appear as purl stitches on the visible side of the rear part of the knitted article.

In rows R7 to R12, purl stitches were formed on the respective opposite needle bed in the front and rear part of the knitted article using needles that carry every second loop. On the front needle bed, these are needles A, E, I, M, Q, U, Y, and on the rear needle bed they are needles b, f, j, n, r, v and z. Overall, a complete stitch row was therefore created in rows R1 to R12 on the front and rear needle bed using alternating plain stitches and purl stitches.

Figure 4:
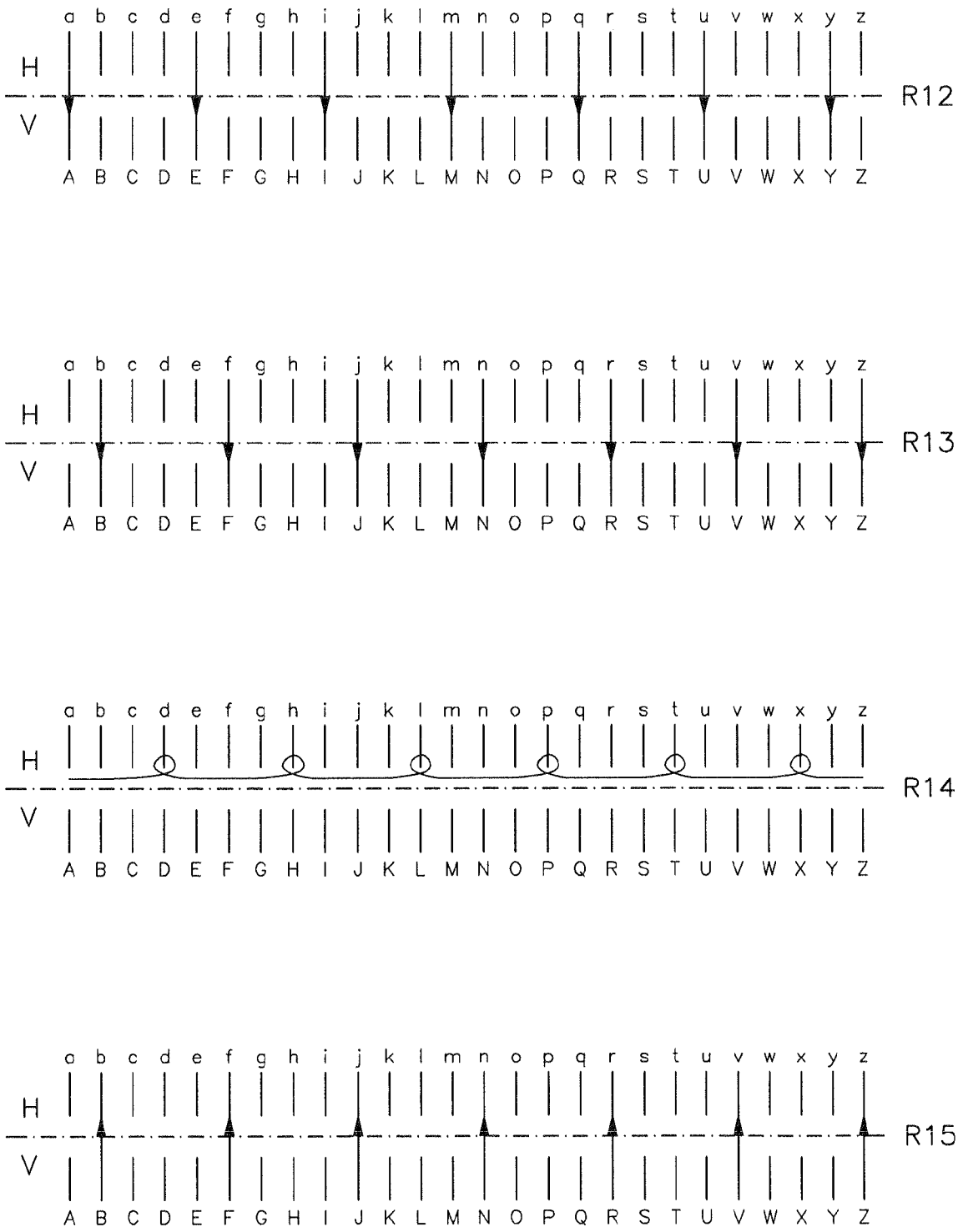
Figure 5:
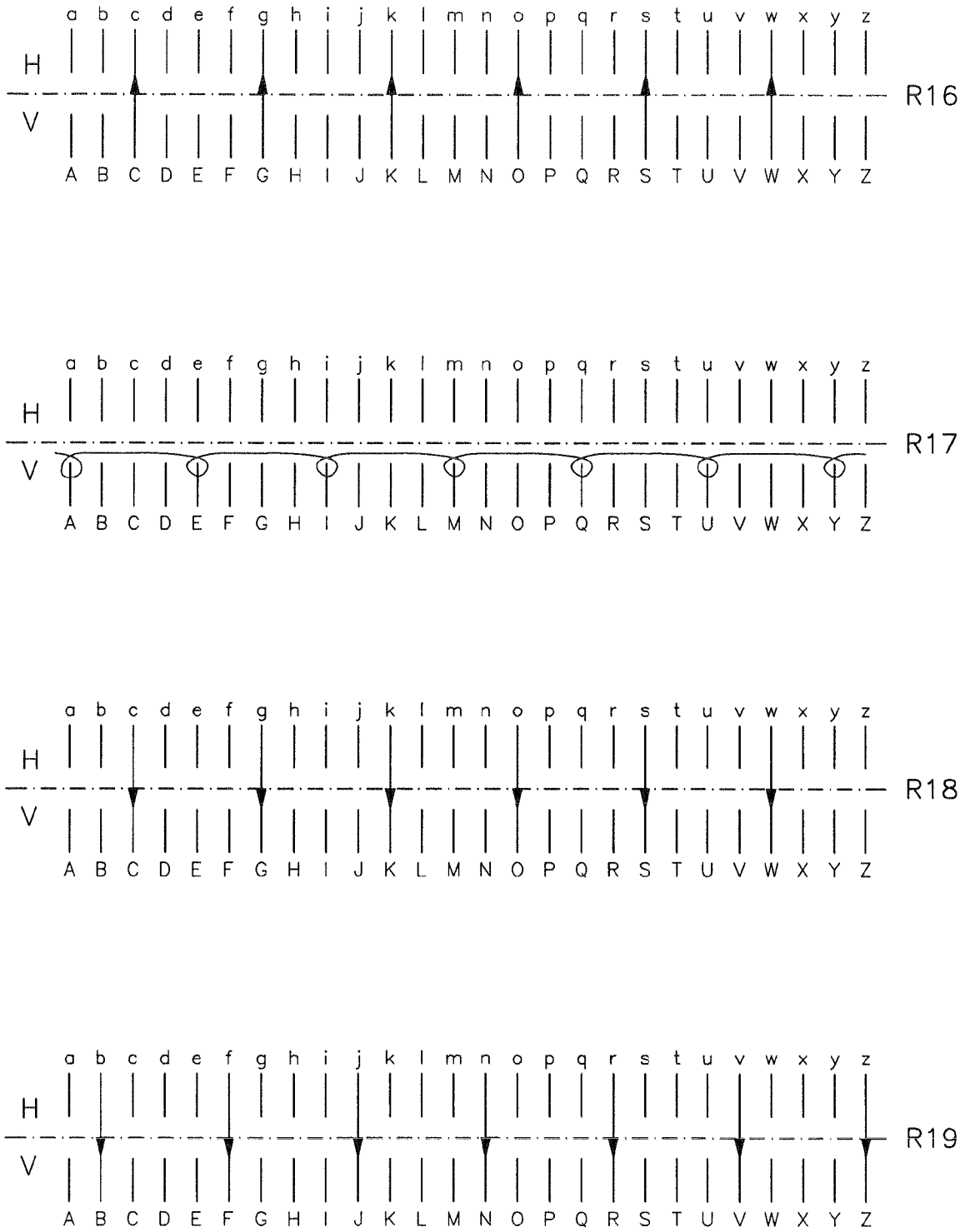
Figure 6:
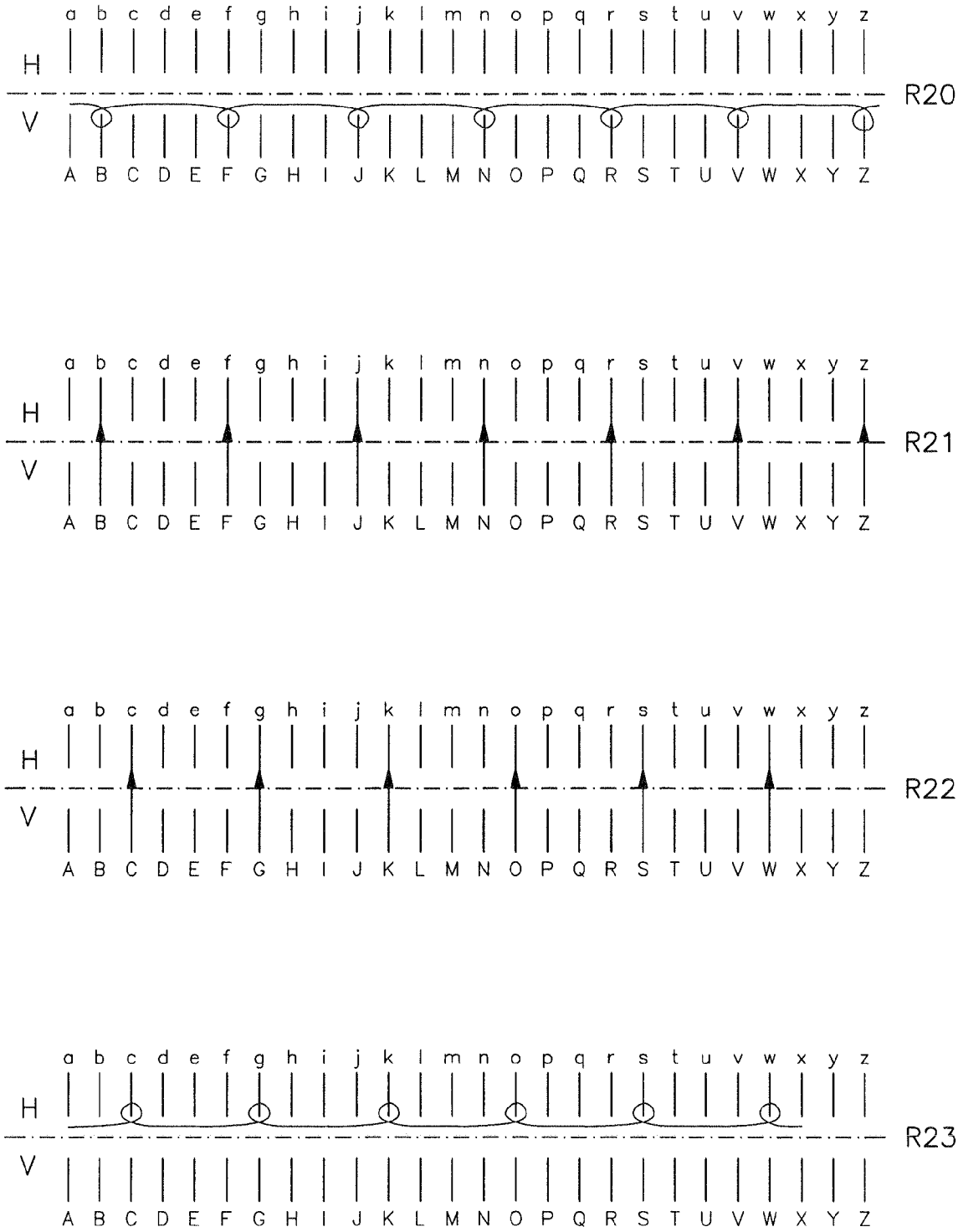
Figure 7:
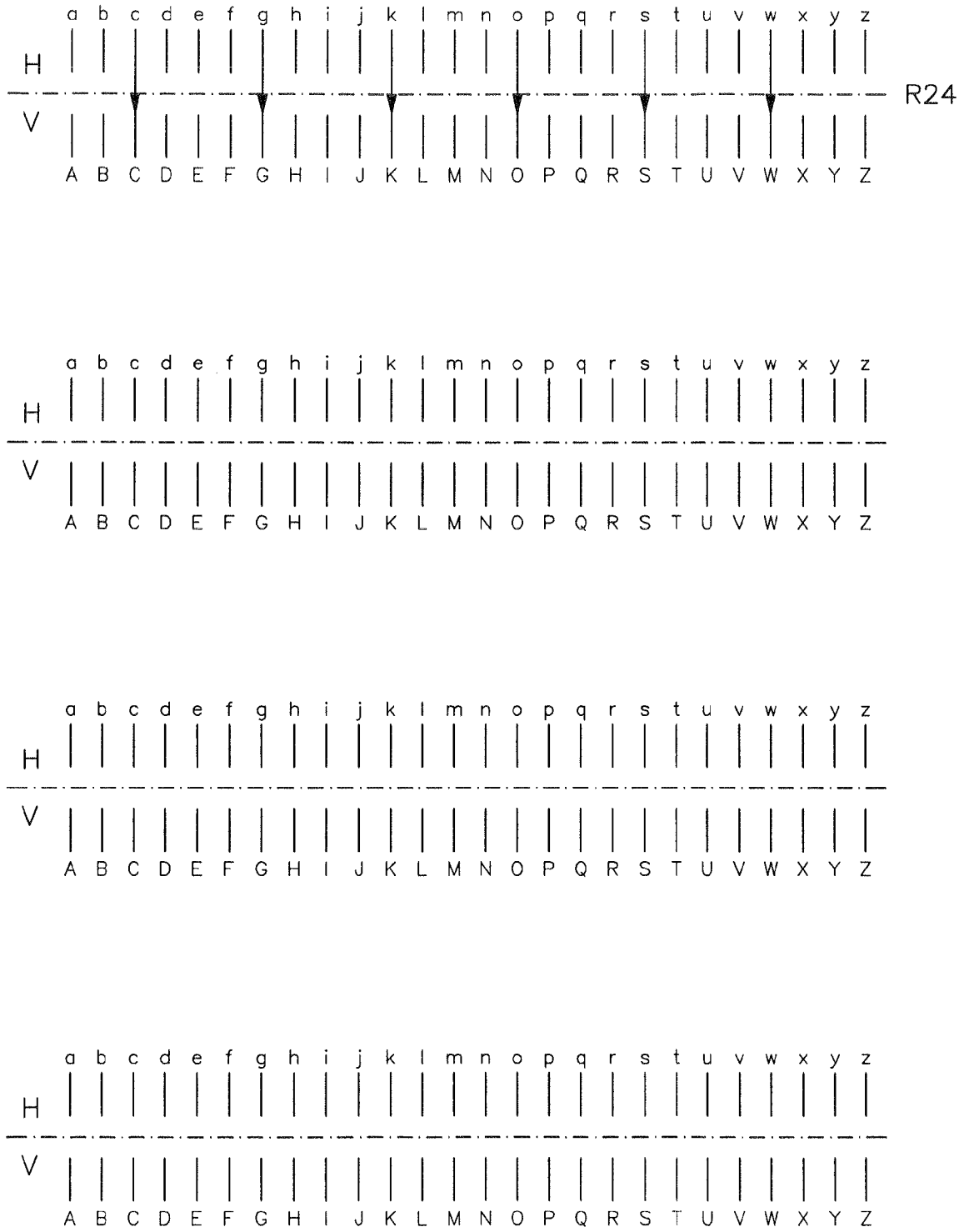
Figure 8:
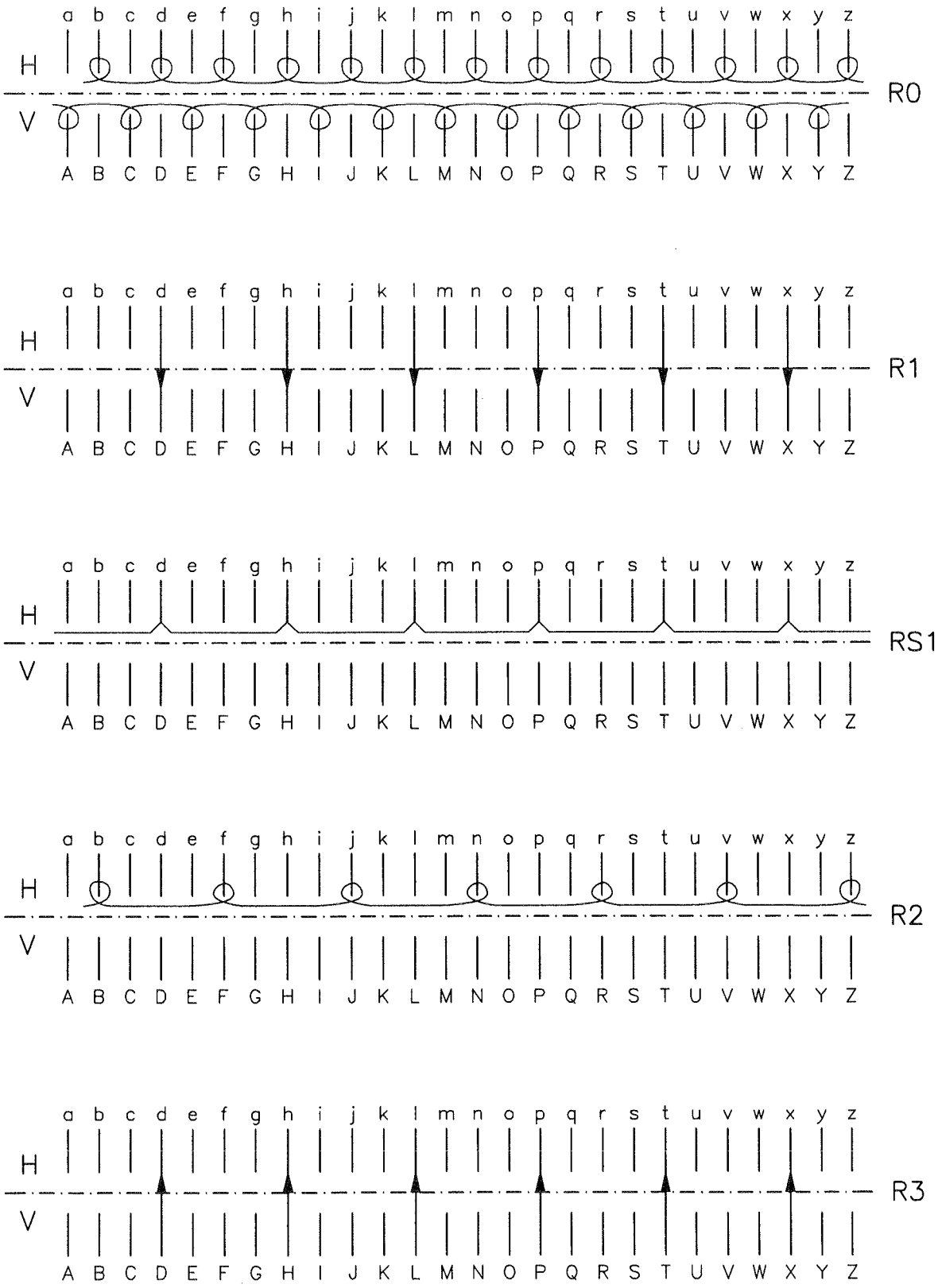
FIG. 8-FIG. 14 show a sequence of knitting rows for executing one pass of a second method.
Figure 9:
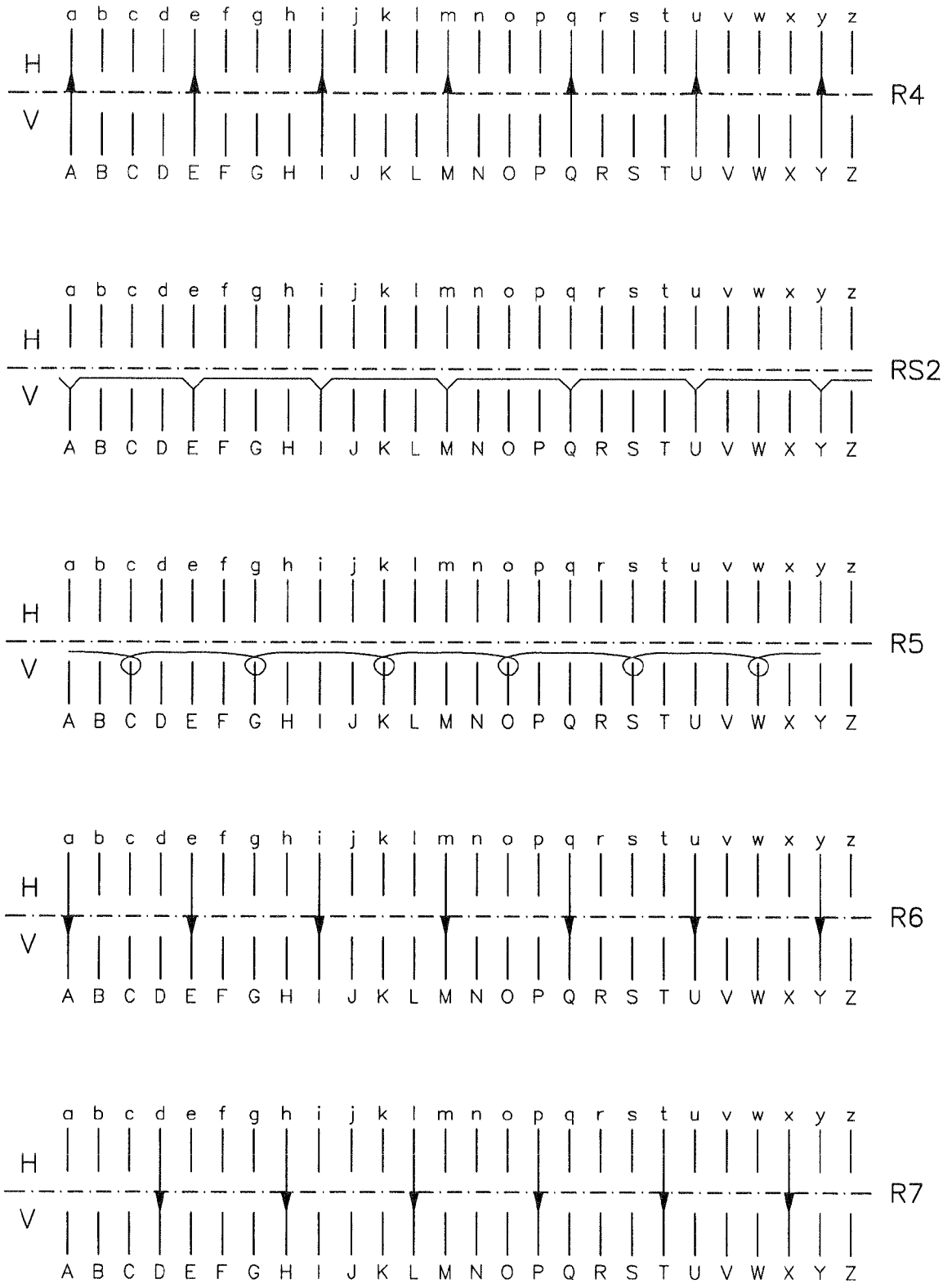
Figure 10:
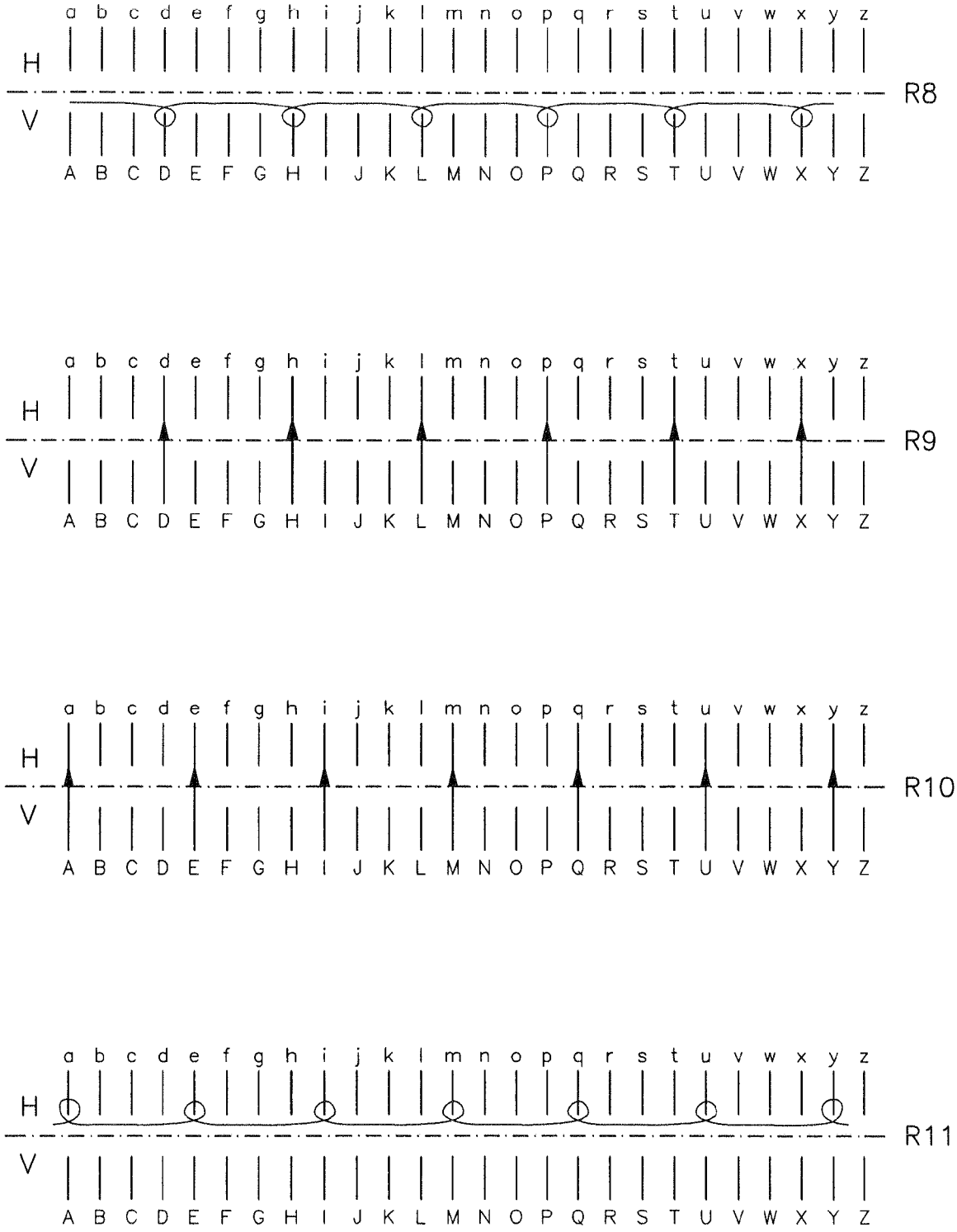
Figure 11:
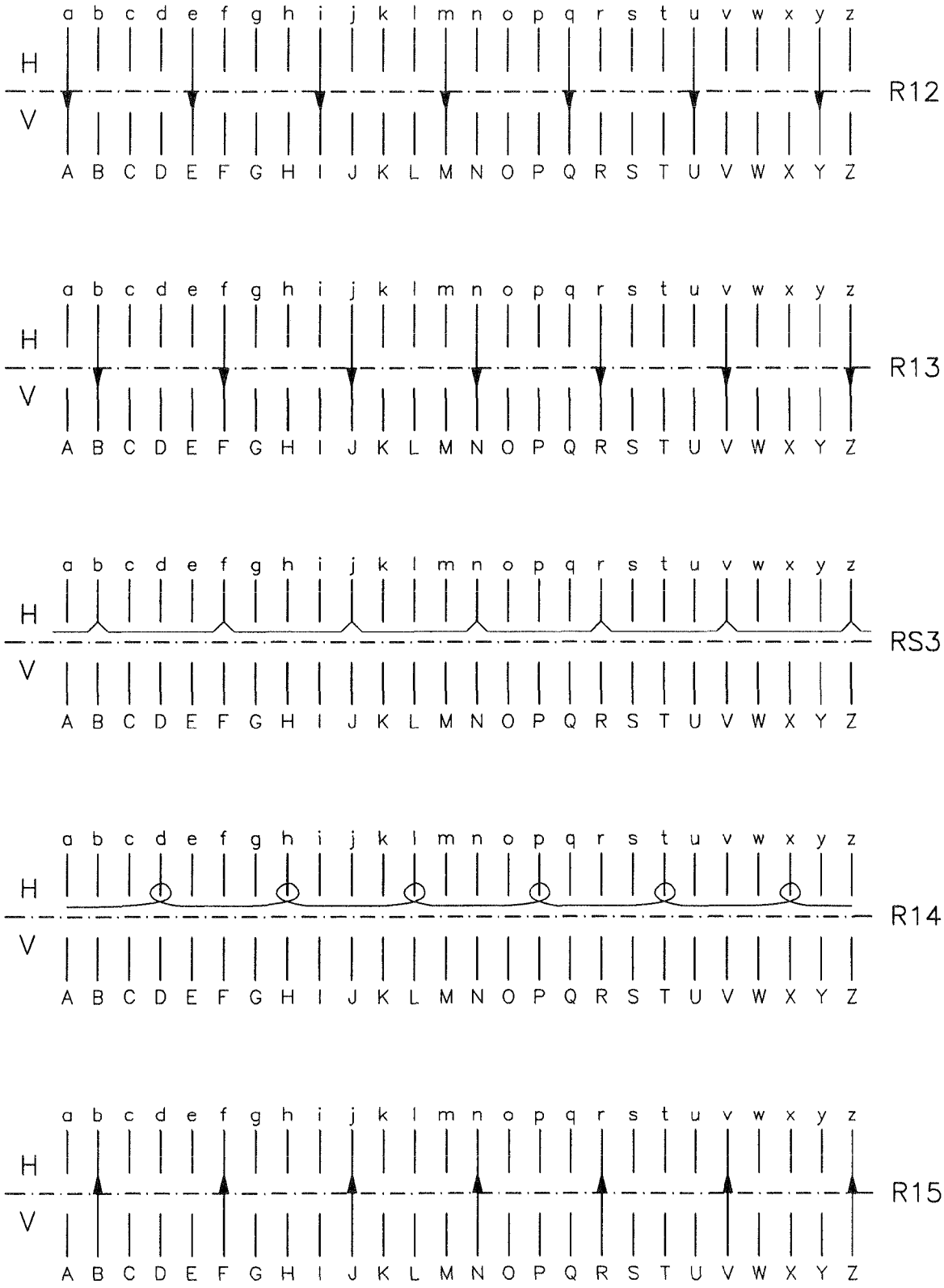

In row R13 (FIG. 4), the loops of the rear part of the knitted article b, f, j, n, r, v and z of the rear needle bed are transferred to the respective opposite empty needles B, F, J, N, R, V, Z of the front needle bed before plain stitches for the rear part of the knitted article are formed in row R14 on needles d, h, l, p, t, x of the rear needle bed, the loops of which were not transferred. In row R15, the loops of the rear part of the knitted article, which were transferred to the front needle bed in row R13, are returned to their original needles b, f, j, n, r, v and z. Next, in row R16, every second loop of the front part of the knitted article, i.e. the loops of needles C, G, K, O, S, W of the front needle bed are transferred to the respective opposite empty needles c, g, k, o, s, w of the rear needle bed so that plain stitches for the front part of the knitted article can then be formed in row R17 on needles A, E, I, M, Q, U, Y of the front needle bed, the loops of which were not transferred. Next, in row R18, the loops of the front part of the knitted article, which were transferred to the rear needle bed in row R16, are returned to their original needles C, G, K, O, S and W of the front needle bed.

In rows R13 to R18, plain stitches were therefore formed in the front and rear part of the knitted article using the needles that formed purl stitches in rows R7 to R12.

Next, in row R19, the loops of the rear part of the knitted article on needles b, f, j, n, r, v, z of the rear needle bed are transferred to the respective opposite empty needles B, F, J, N, R, V and Z of the front needle bed before loops are formed once more in row R20 on the loops of the rear part of the knitted article, which were transferred in row R19 to needles B, F, J, N, R, V and Z of the front needle bed. In row R21, the loops of the rear part of the knitted article, which were transferred to the front needle bed in row R20, are returned to their original needles b, f, j, n, r, v, z of the rear needle bed. They therefore appear as purl stitches on the visible side of the rear part of the knitted article. In row R22, every second loop of the front part of the knitted article, i.e. the loops of needles C, G, K, O, S and W of the front needle bed are transferred to respective opposite empty needles c, g, k, o, s, w of the rear needle bed before loops are formed in row R23 on the loops transferred to needles c, g, k, o, s, w of the rear needle bed in row R22. After these loops of the front part of the knitted article formed in row R23 are returned to their original needles C, G, K, O, S, W of the front needle bed in row R24, they appear as purl stitches on the visible side of the front part of the knitted article.

Overall, purl stitches were therefore formed in the front and rear part of the knitted article in rows R13 to R24 using the needles that formed plain stitches in rows R1 to R6.

The procedure described for rows R1 to R24 is repeated until the desired number of stitch rows has been obtained.

In the variant method presented here, plain stitches and purl stitches are therefore formed in alternation in the longitudinal direction and in the transverse direction of the knitted article, and therefore the knitted article has the same appearance on the outside and the inside.

Figure 12:
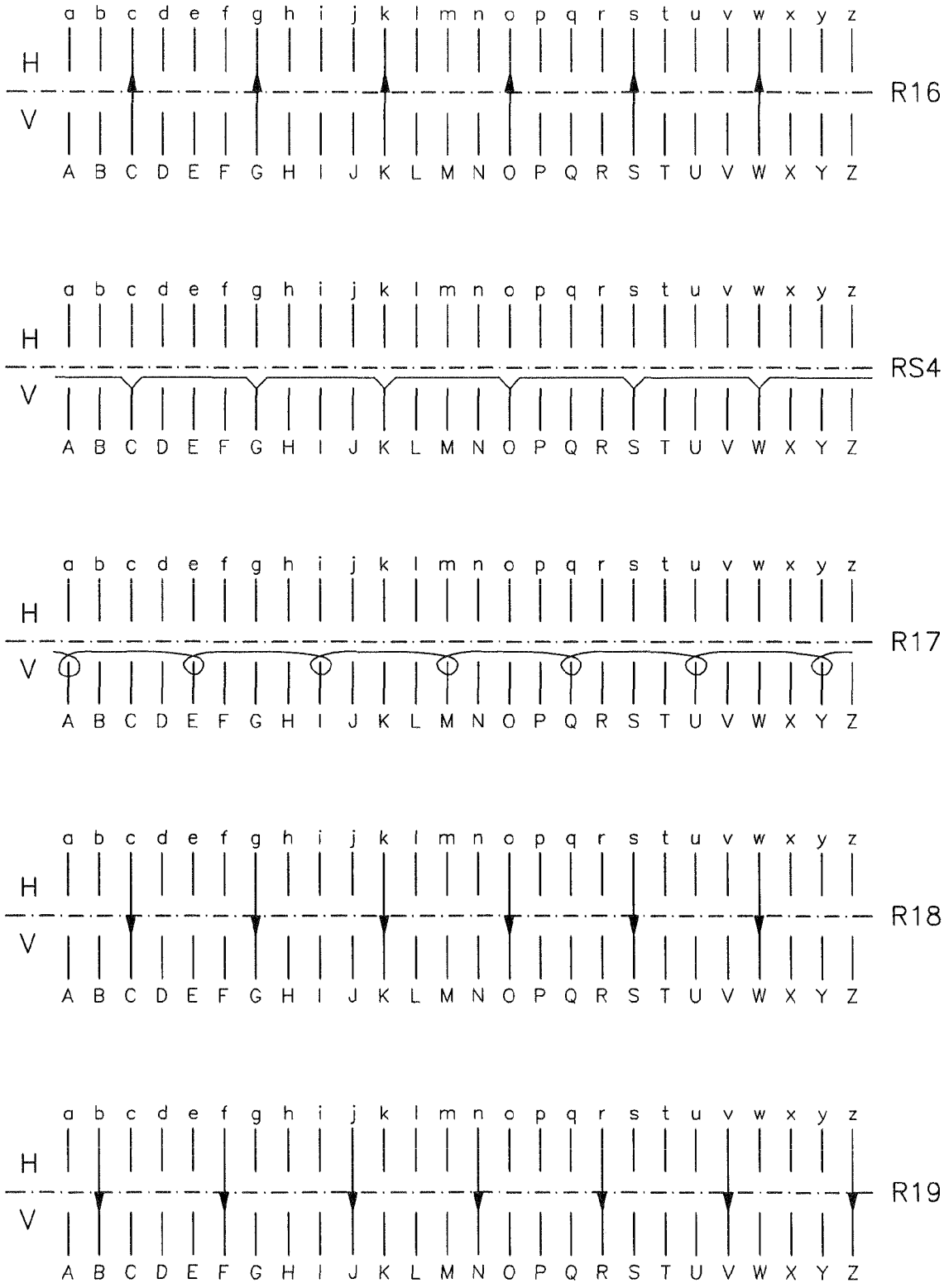
Figure 13:
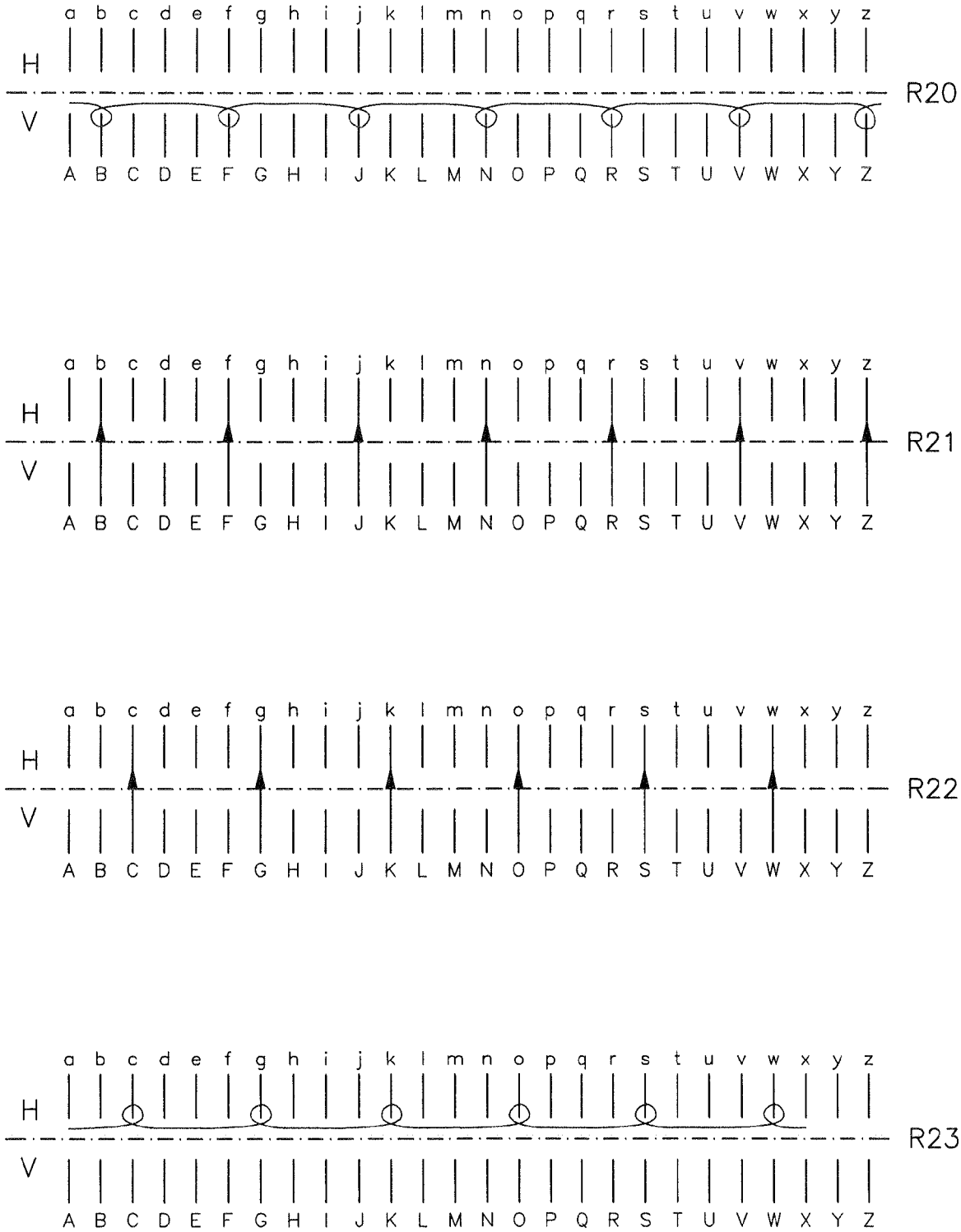
Figure 14:
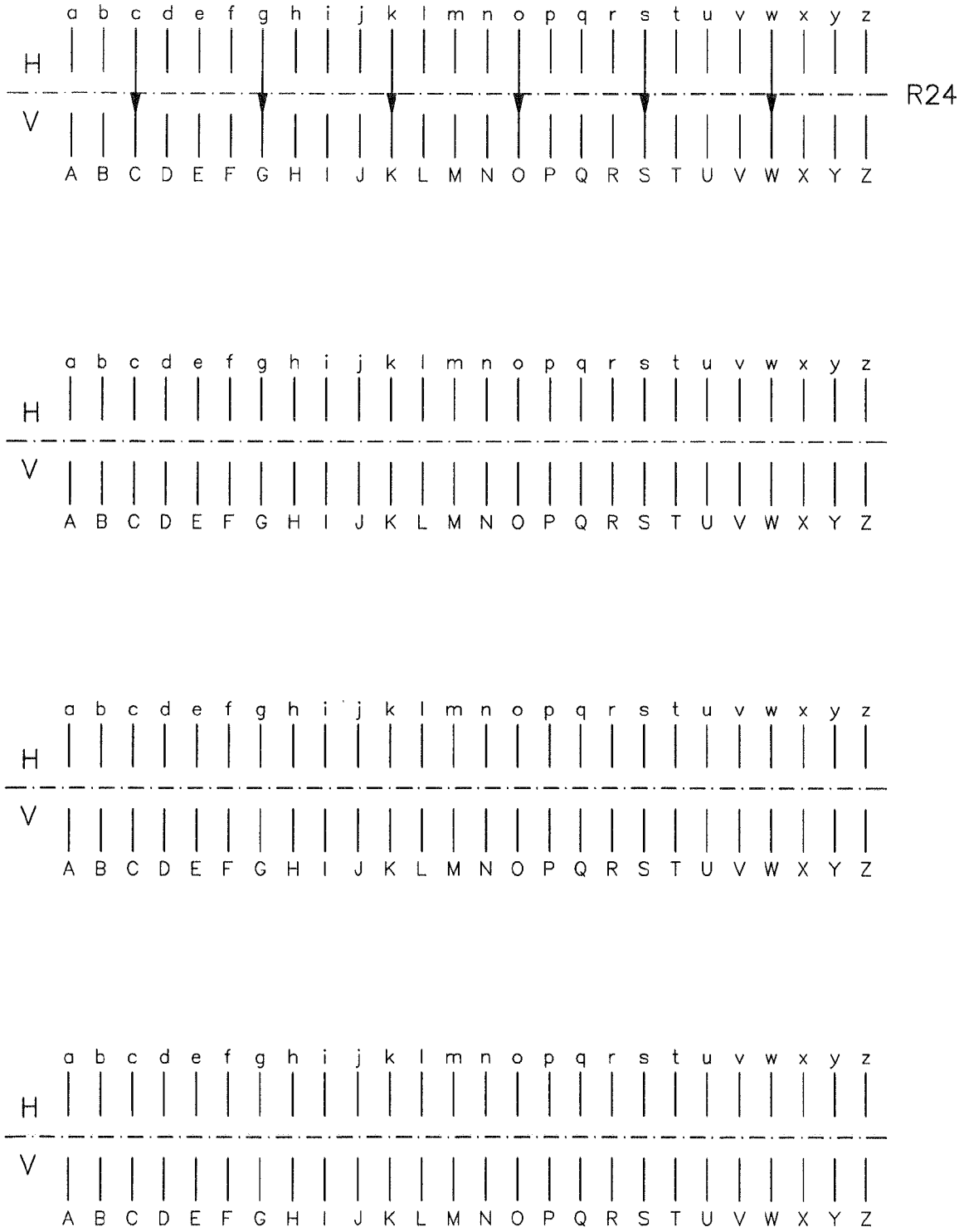

The method according to FIGS. 8 to 14 differs from the method according to FIGS. 1 to 7 by an inlaid weft thread which differs in rows RS1 (FIG. 8), RS2 (FIG. 9), RS3 (FIG. 11) and RS4 (FIG. 12). Tuck loops are formed with the weft thread using every fourth needle of a needle bed in each case. Loops are formed in subsequent rows R2, R5, R14 and R17, and then the weft thread that was inlaid in the previous row is pressed off once more (not depicted).

It will be understood that each of the elements described above, or two or more together, may also find a useful application in other types of methods and constructions differing from the types described above.

While the invention has been illustrated and described as embodied in a device and method for manufacturing a tubular knitted article, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for manufacturing a tubular knitted article having a plurality of stitch rows on a flat knitting machine comprising at least two diametrically opposed needle beds (V, H), which has plain stitches and purl stitches in each stitch row, wherein, at least past a vertical section of the knitted article, purl stitches follow the plain stitches of a stitch row in a subsequent stitch row, and plain stitches follow the purl stitches of the stitch row in the subsequent stitch row in each case, comprising the steps:

a) manufacturing a tubular basic knitted article using at least one stitch row, wherein every needle of a first needle bed (V, H) occupied by a loop is opposite an empty needle of a second needle bed (H, V);

b) forming plain stitches (b, f, j, n, r, z; C, G, K, O, W) on a bed selected from the group consisting of the first needle bed, the second needle bed and both after transferring the loops to be knitted as purl stitches to an opposite one of the needle beds;

c) returning the loops transferred in step b) to their original needles;

d) forming purl stitches (d, h, l, p, t, x; A, E, I, M, Q, U) on a bed selected from the group consisting of the first needle bed, the second needle bed and both after they have been transferred to the opposite needle bed;

e) returning the loops transferred in step d) to their original needles;

f) forming plain stitches (d, h, l, p, t, x; A, E, I, M, Q, U, Y) on a bed selected from the group consisting of the first needle bed, the second needle bed and both using the needles that formed purl stitches in step d), after the plain stitches formed in step b) have been transferred to the opposite needle bed;

g) returning the loops transferred in step f) to their original needles;

h) forming purl stitches (b, f, j, n, r, v, z; C, G, K, O, S, W) on a bed selected from the group consisting of the first needle bed, the second needle bed and both using the needles that formed plain stitches in step b), after transferring these loops to the opposite needle bed;

i) returning the loops transferred in step h) to their original needles;

j) repeating steps b) through i).

2. The method according to claim 1, further comprising repeating each of the steps b) through e) at least once, and then repeating steps f) through i) at least once.

3. The method according to claim 1, further comprising knitting each of the stitch rows using a 1:1-, 2:2- or 3:3-left/right construction.

4. The method according to claim 1, further comprising knitting each of the stitch rows using a 2:1-, 3:1- or 3:2-left/right construction.

5. The method according to claim 1, further comprising knitting each of the stitch rows using a 1:2-, 1:2- or 3:3-left/right construction.

6. The method according to claim 1, further comprising forming the tubular knitted article as a tube selected from the group consisting of a closed tube and a tube that is open on one side.

7. The method according to claim 1, further comprising inlaying a weft thread into the tubular knitted article in a few stitch rows (RS1, RS2, RS3, RS4) by forming tuck loops using the weft thread on empty needles of a needle bed.

8. A tubular knitted article having a plurality of stitch rows, which comprises plain stitches and purl stitches in each stitch row, wherein, at least past a vertical section of the knitted article, purl stitches follow the plain stitches of a stitch row in a subsequent stitch row, and plain stitches follow the purl stitches of the stitch row in the subsequent stitch row in each case, and which is manufactured according to a method defined in claim 1.

* * * * *